US011091177B2

(12) United States Patent
Weitersberger et al.

(10) Patent No.: US 11,091,177 B2
(45) Date of Patent: Aug. 17, 2021

(54) RAIL VEHICLE AND A METHOD FOR OPERATION OF A RAIL VEHICLE

(71) Applicant: Plasser & Theurer Export von Bahnbaumaschinen Gesellschaft m.b.H., Vienna (AT)

(72) Inventors: Christian Weitersberger, St. Georgen an der Gusen (AT); Christoph Kaiser, St. Stefan am Walde (AT)

(73) Assignee: Piasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 402 days.

(21) Appl. No.: 16/099,534

(22) PCT Filed: May 26, 2017

(86) PCT No.: PCT/EP2017/000625
§ 371 (c)(1),
(2) Date: Nov. 7, 2018

(87) PCT Pub. No.: WO2017/220182
PCT Pub. Date: Dec. 28, 2017

(65) Prior Publication Data

US 2019/0144008 A1 May 16, 2019

(30) Foreign Application Priority Data

Jun. 21, 2016 (AT) ..... GM 148/2016

(51) Int. Cl.
*B61C 9/18* (2006.01)
*B61C 15/14* (2006.01)
*B61C 9/16* (2006.01)

(52) U.S. Cl.
CPC ..... *B61C 9/18* (2013.01); *B61C 9/16* (2013.01); *B61C 15/14* (2013.01)

(58) Field of Classification Search
CPC .... B61C 9/00; B61C 9/08; B61C 9/14; B61C 9/16; B61C 9/18; B61C 9/22; B61C 5/00; B61C 11/00
See application file for complete search history.

(56) References Cited

U.S. PATENT DOCUMENTS 3,752,013 A * 8/1973 Cross ..... F16H 47/04 475/32
3,919,948 A * 11/1975 Kademann ..... B61C 9/14 105/34.1

(Continued)

FOREIGN PATENT DOCUMENTS

CN 1149856 A 5/1997
CN 101922542 A 12/2010

(Continued)

OTHER PUBLICATIONS

International Search Report of PCT/EP2017/000625, dated Nov. 10, 2017.

(Continued)

*Primary Examiner* — Robert J McCarry, Jr.
(74) *Attorney, Agent, or Firm* — Collard & Roe, P.C.

(57) ABSTRACT

A rail vehicle having a vehicle frame supported on on-track undercarriages and a hydraulic drive system powered by a motor. The drive system comprises a hydrodynamic drive associated with a first on-track undercarriage as well as a hydrostatic drive associated with a second on-track undercarriage. With the latter is associated a drive pump connected to a drive motor. The motor is designed for a higher power output than is necessary for the operation of the hydrodynamic drive. A pump distribution gear is switched between the motor and the hydrodynamic drive, via which the drive pump of the hydrostatic drive can be connected. This takes place in dependence on a friction value μ between the rail and wheel.

4 Claims, 2 Drawing Sheets

(56) References Cited

U.S. PATENT DOCUMENTS

| | | | |
|---|---|---|---|
| 5,495,912 | A | 3/1996 | Gray, Jr. et al. |
| 9,849,898 | B2 | 12/2017 | Nitti |
| 2011/0030505 | A1 | 2/2011 | Hoyle et al. |

FOREIGN PATENT DOCUMENTS

| | | | |
|---|---|---|---|
| CN | 202115325 | U | 1/2012 |
| CN | 203419139 | U | 2/2014 |
| DE | 1 074 069 | B | 1/1960 |
| DE | 24 09 333 | A1 | 9/1975 |
| DE | 10 2009 051 478 | A1 | 5/2011 |
| GB | 808 339 | A | 2/1959 |
| LU | 35644 | A1 | 2/1958 |
| WO | 2008/031541 | A1 | 3/2008 |
| WO | 2015/128770 | A1 | 9/2015 |

OTHER PUBLICATIONS

Letter summarizing the Chinese Office Action in Chinese Application No. 201780038326.5 dated Mar. 20, 2020 and the Response filed on Apr. 29, 2020 with English translation of the pending claims.

Chinese Office Action in Chinese Application No. 201780038326.5, dated Mar. 20, 2020.

* cited by examiner

RAIL VEHICLE AND A METHOD FOR OPERATION OF A RAIL VEHICLE

CROSS REFERENCE TO RELATED APPLICATIONS

This application is the National Stage of PCT/EP2017/000625 filed on May 26, 2017, which claims priority under 35 U.S.C. § 119 of Austrian Application No. GM 148/2016 filed on Jun. 21, 2016, the disclosures of which are incorporated by reference. The international application under PCT article 21(2) was not published in English.

FIELD OF TECHNOLOGY

The invention relates to a rail vehicle having a vehicle frame supported on on-track undercarriages and a hydraulic drive system powered by a motor, the drive system comprising a hydrodynamic drive associated with a first on-track undercarriage as well as a hydrostatic drive, associated with a second on-track undercarriage, with which is associated a drive pump connected to a drive motor. The invention also relates to a method for operation of said rail vehicle.

PRIOR ART

Rail vehicles and track maintenance machines with hydrodynamic and/or hydrostatic drive are already well known. The power required for the operation of such vehicles is the product of traction and speed. The traction, in turn, is dependent on the mass of the rail vehicle, the number of axles (total or driven) as well as on the friction value between rail and wheel.

Thus, WO 2015/128770 A1 describes a method for operation of a rail vehicle and a rail vehicle in which both a hydrodynamic as well as a hydrostatic transmission powered by the same motor are used either selectively or together. The use of the transmissions occurs in dependence on the travel speed and the friction rail/wheel.

According to DE 24 09 333 A1, a shunting locomotive is known which can be operated selectively via a hydrodynamic or a hydrostatic transmission.

SUMMARY OF THE INVENTION

It is the object of the invention to provide a rail vehicle and a method for the operation thereof, by means of which it is possible to achieve an optimal power distribution of the drives under changing friction values between wheel and rail.

According to the invention, this object is achieved in that the motor is designed for higher power output than necessary for the operation of the hydrodynamic drive, and that a pump distribution gear is switched between the motor and the hydrodynamic drive, via which the drive pump of the hydrostatic drive can be connected.

This configuration ensures a very good transmission of the drive power to the rail. In this, a constant power transmission is achieved especially under often-changing external weather- or season-dependent conditions and the resulting changes of the friction value. Rain, snow and ice, but also contamination by mud or autumn leaves change the friction value in a most unfavourable way. By adding the hydrostatic drive and powering several axles, according to the invention, spinning but also sliding of the wheels is reliably avoided.

A useful further development is realized in that at least one additional hydraulic pump for operation of at least one additional hydraulic drive for a work unit is associated with the pump distribution gear.

With a design such as this, different working units, like a crane, lifting platform, plough or also a snow blower, can be powered with a hydraulic drive which is optimally configured for the operation of the particular unit. The drive consisting of pump and motor can be dimensioned according to the special requirements, so that an economical and performance-adapted operation is ensured.

The object of the invention is also achieved by application of a method in a rail vehicle according to the invention, in that the hydrostatic drive is added or removed in dependence on a friction value μ between rail and wheel.

A particularly advantageous embodiment of the method is achieved by way of the following steps: a) detecting a sinking friction value μ during operation with hydrodynamic drive, b) switching the hydrostatic drive on by engaging the drive pump and the second drive motor, c) increasing the output of the motor, d) operating the rail vehicle with hydrodynamic and hydrostatic drive, e) reducing the output of the motor upon exceeding a critical speed, f) switching the hydrostatic drive off by disengaging the drive pump and the drive motor, and g) operating the rail vehicle with hydrodynamic drive.

Such method steps enable a reliable and safe operation of the rail vehicle which can be carried out almost independently of the already mentioned aggravated conditions. A simultaneous increasing of the motor output and distribution of said output to the hydrodynamic and the hydrostatic drive enables an operation of the rail vehicle largely uninfluenced by the unfavourable friction value, wherein the required adhesion between rail and wheel is maintained at all times. In the higher speed range, an increased motor output or a drive on several axles is no longer necessary, thus the rail vehicle can be driven again in an energy-saving manner exclusively by the hydrodynamic drive.

BRIEF DESCRIPTION OF THE DRAWINGS

The invention will be explained below by way of example with reference to the attached figures. There is shown in.

DESCRIPTION OF THE EMBODIMENTS

Figure 1:
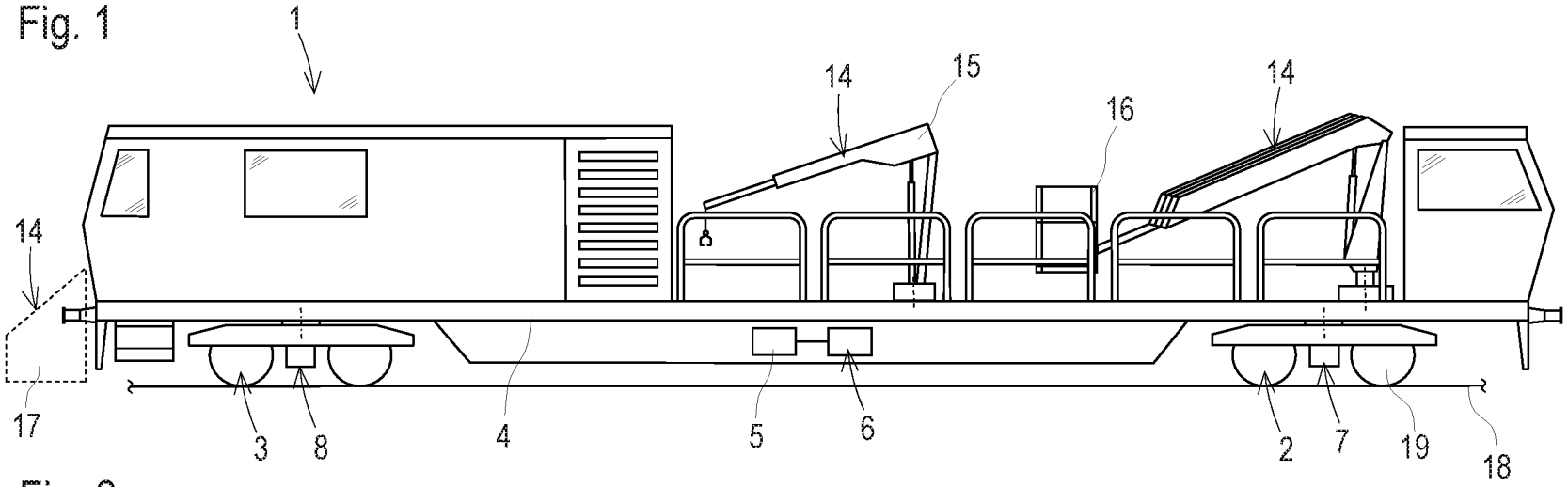
FIG. 1 a schematic side view of a rail vehicle.
Figure 2:
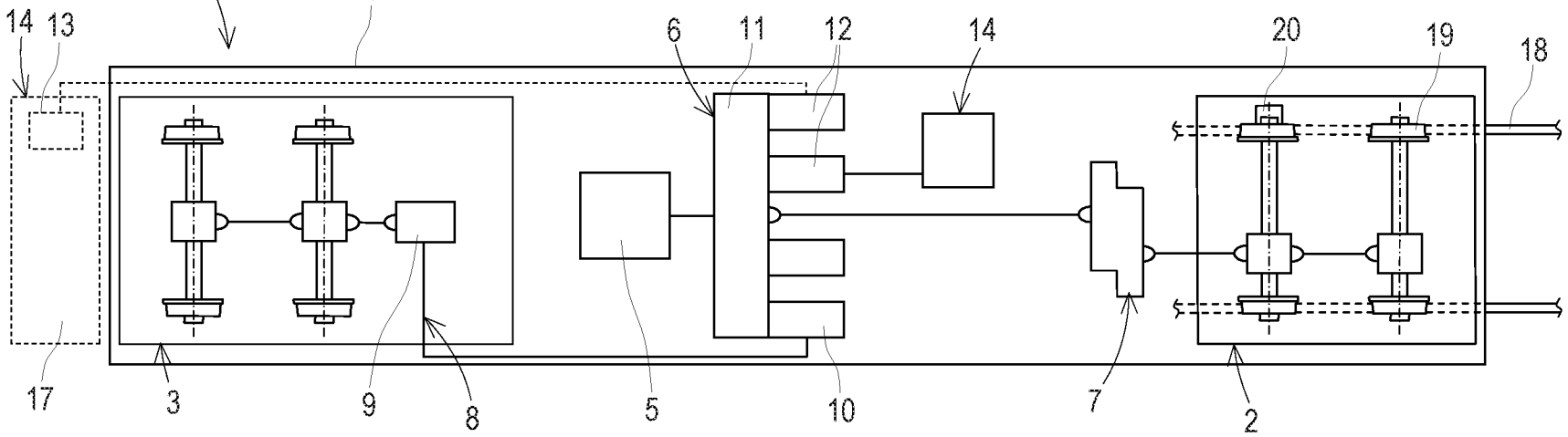
FIG. 2 a drive scheme of the rail vehicle.

Shown in FIG. 1 is a rail vehicle 1 designed as a track maintenance machine. The vehicle is essentially composed of a vehicle frame 4 supported on a first and a second on-track undercarriage 2, 3. The rail vehicle 1 has a hydraulic drive system 6 powered by a motor 5 preferably configured as an internal combustion engine. Said drive system 6 comprises a hydrodynamic drive 7 associated with the first on-track undercarriage 2, and a hydrostatic drive 8 associated with the second on-track undercarriage 3. As visible in FIG. 2, a drive pump 10 connected to the drive motor 9 is associated with the hydrostatic drive 8.

The motor 5 is designed for a higher power output than that required for the operation of the hydrodynamic drive 7. Switched between the motor 5 and the hydrodynamic drive 7 is a pump distribution gear 11. By means of the latter, the drive pump 10 of the hydrostatic drive 8 can be added.

Associated with the pump distribution gear 11 is at least one additional hydraulic pump 12 for operation of at least one additional hydraulic drive 13 for a work unit 14. Examples of such work units 14 would be a crane 15, lifting platform 16 or snow blower 17. In this, the number of the additional hydraulic pumps 12 may vary inasmuch as either a separate hydraulic pump 12 is associated with each work unit 14, or one hydraulic pump 12 alternatingly drives one of the work units 14.

The operation of the rail vehicle 1 will now be described briefly. The operation takes place in dependence on a friction value μ between a rail 18 and a wheel 19, wherein the hydrostatic drive 8 is added or removed.

Generally, the rail vehicle 1 is moved mainly by means of the hydrodynamic drive 7. With the aid of a measuring device 20, the sinking friction value μ is determined. Then, manual or automatic switching-on of the hydrostatic drive 8 takes place by engaging the clutch of the drive pump 10 and the drive motor 9. With increasing the output of the motor 5, the rail vehicle 1 is now operated with hydrodynamic and hydrostatic drive 7, 8. Upon exceeding a critical speed $v_K$, the output of the motor 5 is reduced again and the hydrostatic drive 8 is switched off. This takes place by disengaging the drive pump 10 and the drive motor 9. Thereafter, the rail vehicle 1 is again powered only by the hydrodynamic drive 7.

Figure 3:
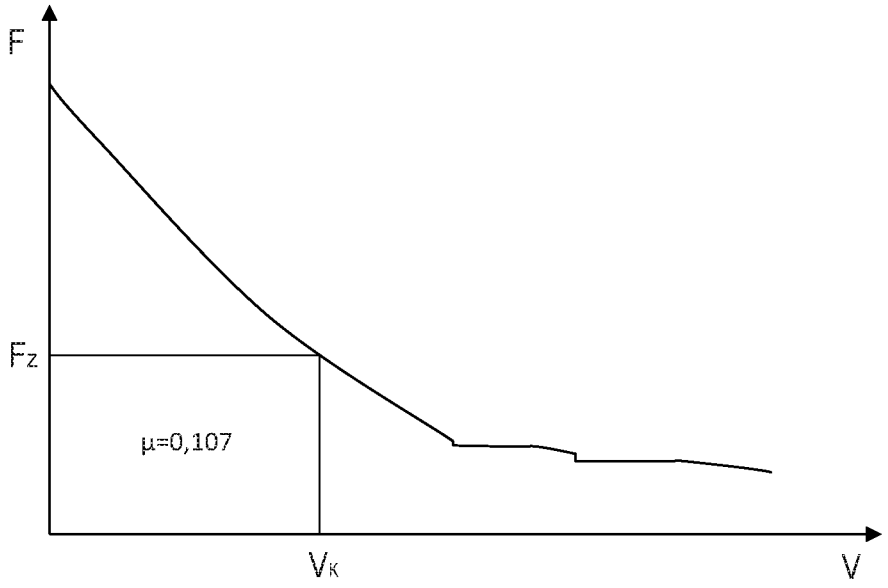
FIG. 3 a speed/traction diagram.

As can be perceived from the diagram in FIG. 3, the critical speed $v_K$ is approximately 50 km/h. Up to this value, a combined drive (hydrodynamic and hydrostatic) with sufficient traction $F_Z$ is possible. At higher speeds v, a friction value μ=0.107 is already sufficient to employ the reduced motor output via the hydrodynamic drive 7.

The invention claimed is:

1. A rail vehicle comprising:

on track undercarriages;

a vehicle frame supported on said on-track undercarriages a hydraulic drive system comprising:

a motor, a hydrodynamic drive associated with a first on-track undercarriage; a hydrostatic drive, associated with a second on-track undercarriage, a drive motor;

a pump distribution gear;

a drive pump connected to said drive motor, wherein the motor is designed for higher power output than necessary for the operation of the hydrodynamic drive, and wherein said pump distribution gear is switched between the motor and the hydrodynamic drive, via which the drive pump of the hydrostatic drive can be connected.

2. The rail vehicle according to claim 1, wherein at least one additional hydraulic pump for operation of at least one additional hydraulic drive for a work unit is associated with the pump distribution gear.

3. A method for operation of the rail vehicle with a hydraulic drive system including on track undercarriages;

a vehicle frame supported on said on-track undercarriages a hydraulic drive system comprising:

a motor, a hydrodynamic drive associated with a first on-track undercarriage;

a hydrostatic drive, associated with a second on-track undercarriage, a drive motor;

a pump distribution gear;

a drive pump connected to said drive motor, wherein the motor is designed for higher power output than necessary for the operation of the hydrodynamic drive, and wherein said pump distribution gear is switched between the motor and the hydrodynamic drive, via which the drive pump of the hydrostatic drive can be connected; the method comprising the step of:

wherein the hydrostatic drive is added or removed in dependence on a friction value μ between the rail and wheel.

4. The method according to claim 3, comprising the following steps:

a) detecting a sinking friction value μ during operation with hydrodynamic drive, b) switching the hydrostatic drive on by engaging the drive pump and the drive motor, c) increasing the output of the motor, d) operating the rail vehicle with hydrodynamic and hydrostatic drive, e) reducing the output of the motor upon exceeding a critical speed vK, f) switching the hydrostatic drive off by disengaging the drive pump and the drive motor, and g) operating the rail vehicle with hydrodynamic drive.

* * * * *